United States Patent [19]

Nettelbeck et al.

[11] Patent Number: 4,660,619

[45] Date of Patent: Apr. 28, 1987

[54] MOLD COOLING APPARATUS AND METHOD FOR CONTINUOUS CASTING MACHINES

[75] Inventors: Klaus Nettelbeck, Pittsburgh; James D. McVay, Youngwood; Hermann Take, Pittsburgh, all of Pa.

[73] Assignee: Continuous Casting Systems Inc., Pittsburgh, Pa.

[21] Appl. No.: 758,144

[22] Filed: Jul. 23, 1985

[51] Int. Cl.[4] ..... B22D 11/22

[52] U.S. Cl. ..... 164/455; 164/443

[58] Field of Search ..... 164/455, 486, 487, 443, 164/451, 452; 239/9, 61, 132, 132.1, 132.5

[56] References Cited

U.S. PATENT DOCUMENTS

| | | | |
|---|---|---|---|
| 2,947,075 | 8/1960 | Schneckenburger . | |
| 3,049,769 | 8/1962 | Schultz . | |
| 3,297,257 | 1/1967 | Roser | 239/61 |
| 3,502,133 | 3/1970 | Carson . | |
| 3,592,259 | 7/1971 | Adamec et al. . | |
| 3,620,295 | 11/1971 | Dain . | |
| 3,759,309 | 9/1973 | Nighman . | |
| 4,019,560 | 4/1977 | Gruner | 164/486 |
| 4,024,764 | 5/1977 | Shipman et al. . | |
| 4,483,385 | 11/1984 | Kurzinski . | |
| 4,483,387 | 11/1984 | Chielens et al. . | |
| 4,494,594 | 1/1985 | Kurzinski . | |

FOREIGN PATENT DOCUMENTS

| | | | |
|---|---|---|---|
| 58-176055 | 10/1983 | Japan | 164/451 |
| 835614 | 6/1981 | U.S.S.R. | 164/443 |

*Primary Examiner*—Nicholas P. Godici
*Assistant Examiner*—G. M. Reid
*Attorney, Agent, or Firm*—Fred Wiviott

[57] ABSTRACT

A continuous casting machine has an open ended flow-through mold surrounded by a plurality of spray nozzles connected in groups to segregated sources of water and air for dispensing the same individually or in combination. The spray nozzles are positioned to provide multiple zones of cooling. Each nozzle may include a mixing valve operated by a control which in turn is connected to an individual temperature sensor mounted on the surface of the mold in an opposed relation to each nozzle. The control establishes the flow rates of air and water at each nozzle in accordance with the individual temperature of that portion of the mold whose temperature is affected by the respective nozzle.

6 Claims, 3 Drawing Figures

MOLD COOLING APPARATUS AND METHOD FOR CONTINUOUS CASTING MACHINES

BACKGROUND OF THE INVENTION

This invention relates to high temperature metal continuous casting machines, and more particularly, to an improved mold cooling system for continuous casting machines.

In conventional continuous casting machines, molten metal is passed through an open ended flow through mold which may be curved or straight. The mold may be oriented vertically or horizontally and is generally square or rectangular in shape but may be of various geometrical configurations.

The mold which forms the metal strand confines the liquid metal and provides for its initial solidification, or formation of the encasing shell. The solidifying strand is extracted continuously from the bottom or exit end of the mold at a rate equal to that of the incoming liquid metal at the top or entrance end, the production rate being determined by the time required for the outer shell to harden sufficiently so as to contain the inner liquious core by the time the strand exits the confines of the mold.

In one prior art method of cooling the liquid metal in continuous casting machines, a water system recirculates cooling water around the outside of the mold cavity liner. The water enters into the bottom of a pressure tight vessel in which the mold cavity liners are contained and flows upward along the outer surface (or cold face) of the mold cavity liner in a direction opposite from that of the moving liquid metal. This countercurrent water flow has been accepted as the most efficient for heat transfer in continuous casting machines. Because the cooling water is under high pressure and flows at a high velocity an enclosed pressure vessel must be utilized. A sealed cooling system is provided by fixing the mold cavity liners to the pressure tight vessel at both ends.

It is essential that sufficient heat be extracted from the liquid metal through the mold cavity liner by the cooling water to not only produce the required strand shell formation but also to prevent the mold cavity liner from melting. Contact between the liquid metal and the mold cooling water may result in a steam generated explosion.

As heat transfers from the liquid steel to the circulating cooling water, through the walls of the mold cavity liners, some of the water evaporates resulting in the creation of a steam barrier on the surface of the mold liner which tends to reduce, and limit, heat transfer. Also, because there is no adjustable control of the water flow rate as it passes over the outside (or cold) surface of the mold cavity liners, there is a tendency for the solidified shell of the cast strand to contract as it cools thereby resulting in the formation of gaps between the newly formed solidified skin and the mold cavity liners. These gaps also result in a reduction of heat transfer and cause reheating of the solidified shell. A combination of this reheating effect and the ferrostatic pressure will subsequently cause the solidified shell to expand and contract the mold cavity liner again. This process of contraction and expansion will be repeated continually as the strands pass through the confines of the mold cavity liner.

One type of prior art continuous casting machine cooling system such as that shown in U.S. Pat. No. 3,759,309, attempts to control the solidification rate within the mold by spraying steam heated water at a controlled temperature against the outer surface of the mold.

In another type of prior art device disclosed in U.S. Pat. No. 3,049,769, mold cooling was achieved by providing individual flow passages along the mold surface. While this did provide some limited control circumferentially, there was no control longitudinally along the mold surface. In addition, prior art mold cooling systems which include this type of integral cooling jacket required substantially larger and more complicated mold oscillation systems in order to oscillate both the mold and the relatively heavy cooling system components.

SUMMARY OF THE INVENTION

It is an object of the invention to provide a new and improved cooling system for continuous casting machine molds.

Another object of the invention is to provide a cooling system which individually controls the temperature at a plurality of areas on the surface of a continuous casting mold.

A further object of the invention is to provide a cooling system for continuous casting molds which is not physically mounted on the mold structure to permit a less complicated mold oscillating mechanism.

These and other objects and advantages of the present invention will become more apparent from the detailed description of the invention taken with the accompanying drawings.

In general terms, the invention comprises an open ended mold and a cooling system comprising a plurality of spray nozzle assemblies arranged in spaced apart relation around the mold. The nozzle assemblies are oriented toward the mold so that water discharged from each nozzle assembly will primarily impact a separate area on the mold surface. Each of the nozzle assemblies is coupled to segregated sources of cooling water and air and means are provided for individually controlling the flow rate of water and air to each nozzle or groups of nozzles for individually controlling the cooling rate at each separate cooling zone on the mold surface impacted by cooling water from respective ones of the nozzle assemblies.

DETAILED DESCRIPTION OF THE PREFERRED EMBODIMENT

Figure 1:
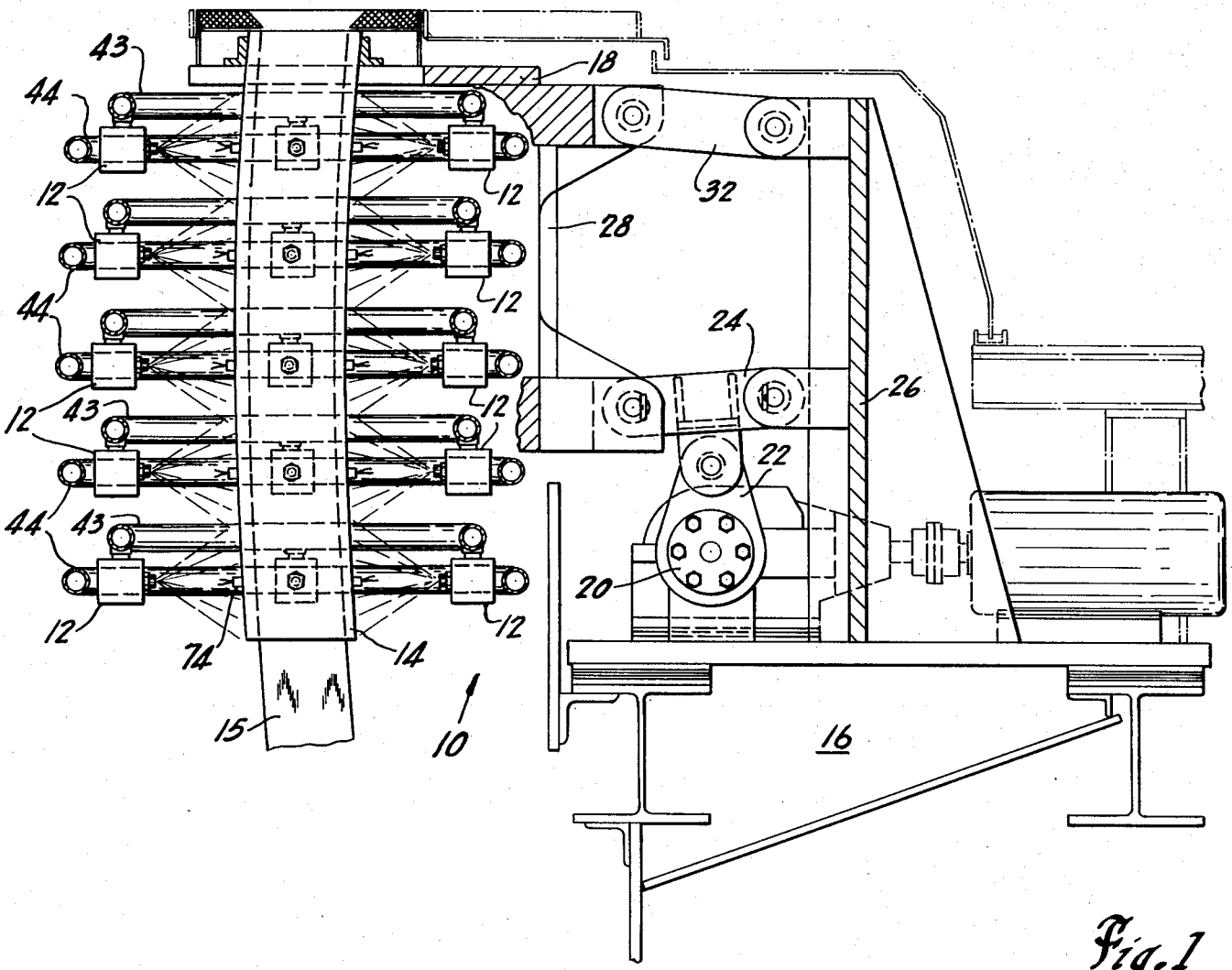
FIG. 1 is a side elevational view, with parts broken away, of the mold cooling system in accordance with the preferred embodiment of the invention.
Figure 2:
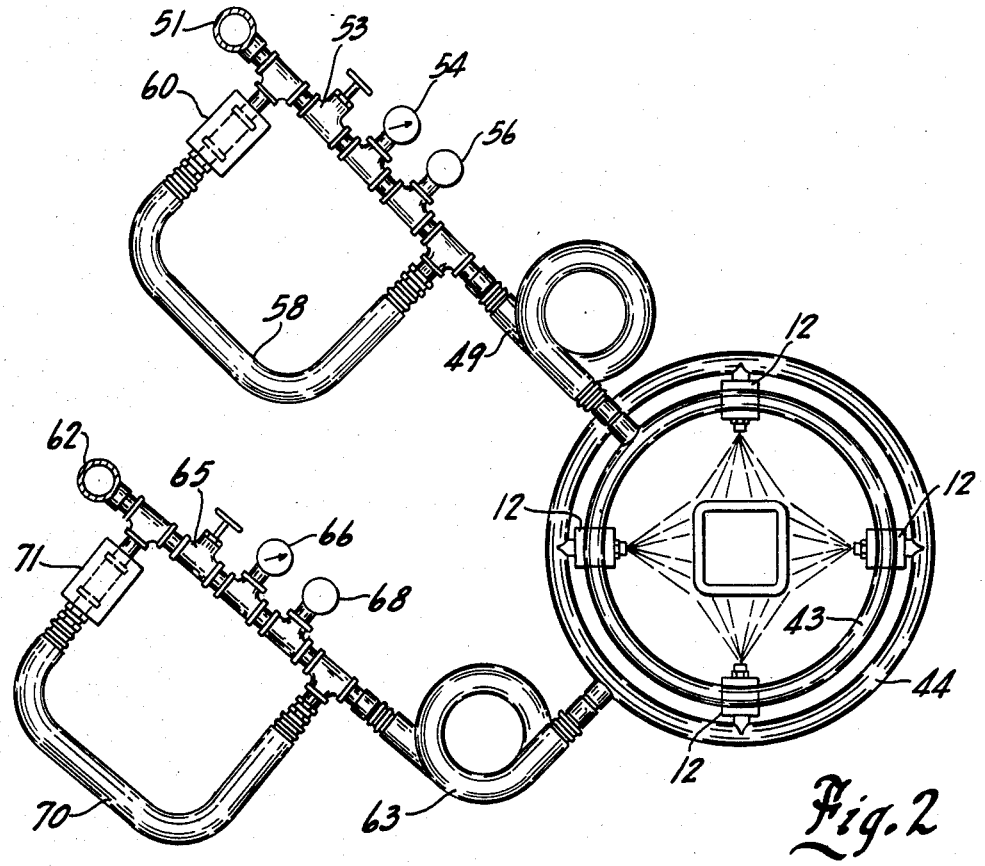
FIG. 2 is a top view of the mold cooling system shown in FIG. 1.

FIG. 1 schematically illustrates the mold cooling system 10 in accordance with one embodiment of the invention. In particular, the mold cooling system 10 includes a plurality of individual spray nozzle assemblies 12 disposed in surrounding relation to an open ended flow-through mold 14.

As those skilled in the art will appreciate, the mold 14 may consist of a hollow metallic member which, in the illustrated example, is slightly arcuate with a center curvature which defines the machine casting radius. Those skilled in the art will also appreciate that in the operation of a casting machine, molten metal will be delivered to the open upper end of the mold 14 from a tundish (not shown). As the molten metal passes through the mold 10, it will begin to solidify from its outer surface inwardly so that it will have a solidified skin and a molten core as it is withdrawn as a strand 15 from the open lower end of mold 14 by a withdrawal and straightener assembly which is not shown but is well known in the art.

The mold 14 shown in FIG. 1 to be coupled to a conventional mold oscillating assembly 16 which is schematically illustrated. In particular, the mold is mounted at its upper end to a plate 18 the other end of which is coupled to the oscillating assembly 16. While those skilled in the art will appreciate that any conventional oscillating assembly may be employed, the schematically illustrated assembly includes an eccentric 20 coupled by a link 22 to a lever 24 which is pivotally connected intermediate its ends on a fixed pivot post 26. The other end of lever 24 is pivotally connected to the lower end of a vertical link 28 the upper end of which is coupled to the mold support plate 18. In addition, a link 32 is pivotally connected at its opposite ends to the fixed pivot post 26 and to the link 28 adjacent their upper ends. It will be appreciated that as the eccentric 20 rotates, the mold 14 will be oscillated in a vertical arc. However, because the cooling system 10 is mounted separately from the mold 14, the oscillating assembly 19 need only oscillate the mold and not the cooling assembly 10.

The spray nozzle assemblies 12 of the cooling system 10 are arranged in groups around the mold 14 with the groups being disposed in a vertical spaced relation. While five groups with four nozzle assemblies 12 in each group are shown, it will be understood that the number and placement of the nozzle assemblies will be dictated by the size and geometric configuration of the mold, and the chemical composition of the metal being cast and the withdrawal speed of the strand from the mold.

Each nozzle assembly 12 includes a nozzle 36 mounted on a hollow mixing body 38 and communicating with the hollow interior 39 thereof. Each nozzle assembly 12 are also respectively coupled to circular water and air feed pipes 43 and 44 through inlet passages 46 and 47, respectively.

The water feed pipe 46 is coupled to one end of a water supply pipe 49, the other end of which is connected to a water main pipe 51. Connected in water supply pipe 49 is a manual flow control valve 53, a pressure gauge 54 and a flow indicator 56. A bypass loop 58 having a solenoid valve 60 is connected around manual flow control valve 53 to permit automatic or manual operation. The air feed pipe 47 is similarly connected to an air main pipe 62 through an air supply pipe 63 which also includes a manual operated flow control valve 65, a pressure gauge 66, a flow indicator 68 and a bypass loop 70 having a solenoid operated valve 71. The water and air supplied by pipes 51 and 62 is suitably pressurized for providing the required flow velocities and rates.

In operation, it will normally be desired to remove heat from the strand at a uniform and controlled rate. As a result, the temperature at specific locations on the mold surface should be maintained at some specific desired value. If the heat transfer at any point on the mold surface is too rapid, the strand 15 may shrink away from the inner surface of the mold 14, thereby reducing heat transfer therebetween. In addition, too rapid or uneven cooling can cause the formation of cracks in the outer skin of the strand. To optimize cooling, therefore, it is necessary to maintain the strand 15 in contact with the mold surface. This is accomplished by adjusting the valves 53 and 65 to control the amount and the proportion of air and water in the spray from respective groups of nozzles 12.

While the groups of nozzles 12 are shown to be spaced apart equi-distantly in the vertical direction, it will be appreciated that unequal spacing may be desirable to promote the desired cooling effect.

Figure 3:
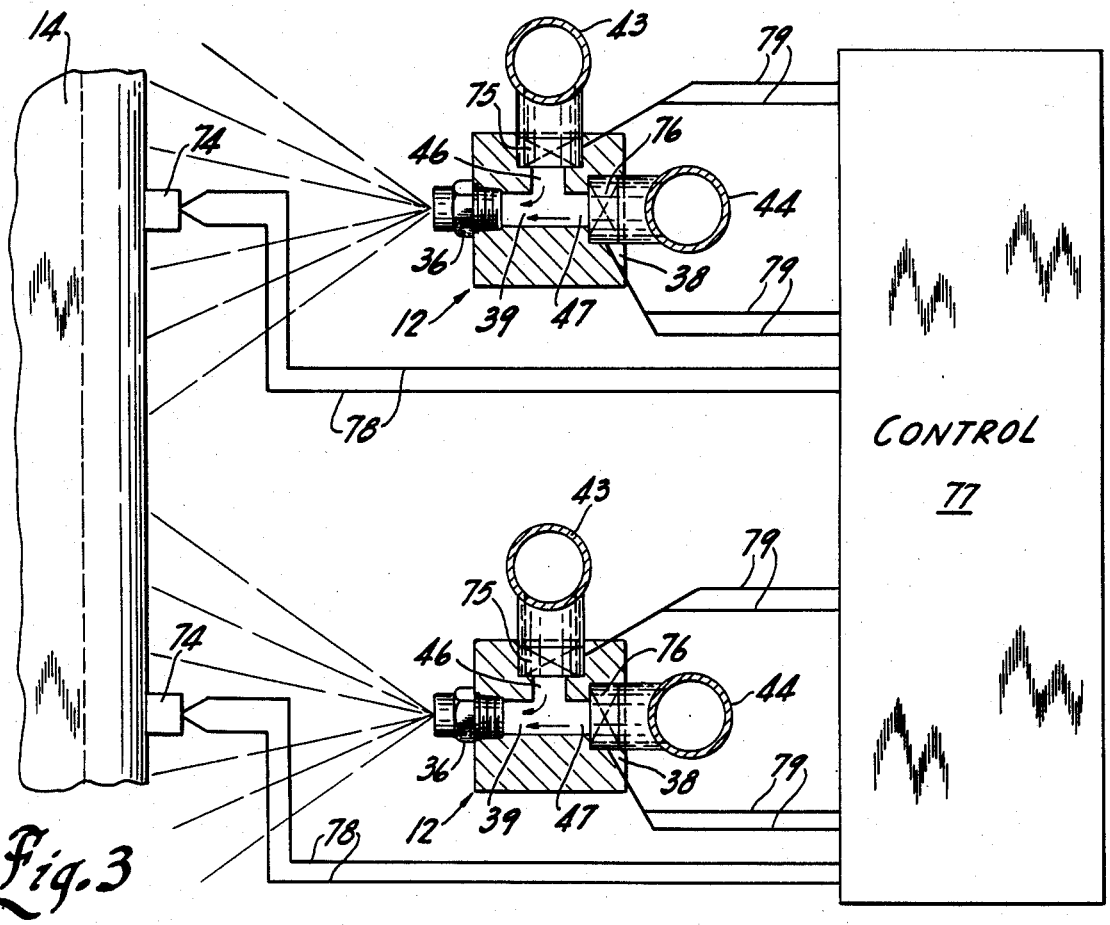
FIG. 3 shows a portion of the cooling system of FIG. 1 in greater detail.

An alternate embodiment of the invention is shown in FIG. 3 to include a plurality of temperature measuring devices, such as thermocouples 74, attached to the surface of the mold 14. In addition, flow metering valves 75 and 76 are mounted on each nozzle 12 and respectively communicate with the cavity 39 through passages 46 and 47. While thermocouples 74 may be located at any appropriate position on the surface of mold 14, in the preferred embodiment one is located opposite each nozzle assembly 12 or in a symmetrical relation to pairs or groups of nozzle assemblies 12. Each thermocouple 74 is electrically connected by conductors 75 to a control 77. In addition, the control 77 is individually coupled by conductors 79 to each of the flow metering valves 40 and 41. The details of the control 77 form no part of the invention and will not be disclosed in detail. It will be sufficient for purposes of understanding the invention to appreciate that the control receives the temperature signals from the thermocouple 74 at each location on the mold 14 and compares the same to a set point temperature previously stored in the control. If the measured temperature at any zone on the mold surface deviates from the set point temperature by a predetermined amount, an appropriate signal will be provided by the control 77 to the flow metering valves 75 and 76 which are in a position to adjust the temperature at the appropriate location, on the mold surface, that is, to the nozzle assembly which is located opposite the thermocouple which senses the incorrect temperature. The flow metering valves 75 and 76 are operative to increase or decrease the flow of air or water, as the case may be, in accordance with the input signal received from the control 77. In particular, a lower than desired temperature in an area of the mold surface indicates that the strand has pulled away from the mold surface at that location. Since the strand is moving downwardly in the mold, the low temperature in one area indicates that the cooling rate in upper or preceding areas of the mold is too rapid. Therefore, the control will react by decreasing the flow rate of water to a nozzle impacting a higher or preceding area of the mold and the flow rate of air will be increased. Conversely, a higher than desired temperature in any mold area indicates that the cooling rate in higher regions of the mold is too low. In the latter event, the flow rate of water to one or more nozzles impacting the mold above the point of temperature measurement will be increased and that of the air decreased.

While only a few embodiments of the invention has been illustrated and described, it is not intended to be limited thereby but only by the scope of the appended claims.

We claim:

1. In a continuous casting machine, an open ended mold, a cooling system comprising a plurality of spray nozzles arranged in a spaced apart relation around said mold, said nozzles being oriented toward said mold so that an air-water mixture discharged from each nozzle will primarily impact a separate area on the outer surface of the mold, each nozzle being coupled to a source of cooling water and to a source of air and each nozzle being constructed and arranged for mixing said air and water for discharging said mixture onto said mold surface, flow metering means coupled to each nozzle for individually and oppositely adjusting the flow rates of water and air to each nozzle for individually controlling the cooling rate at each separate area on the mold surface impacted by the cooling water-air mixture from respective ones of said nozzles by increasing the flow rate of one of the water or air and decreasing the flow rate of the other, said nozzles being arranged in groups, the nozzles of each group being spaced apart around the mold and with the groups being spaced apart vertically one from the other, temperature measuring means for measuring the temperature on the surface of the mold at each of the impact areas, and control means coupled to the flow metering means and the temperature measuring means for individually adjusting the flow rates of the air and water at each individual nozzle in response to the separate temperatures measured by the temperature measuring means at a plurality of impact areas for individually controlling the cooling rate of said mold surface areas.

2. The combination set forth in claim 1 wherein said cooling system is mounted independently of said mold, and oscillating means coupled to the mold for oscillating the same independently of said cooling system.

3. The combination set forth in claim 1, and including individual water and air supply means coupled to the nozzles in each group, said control means separately adjusting the flow rates of air and water at each nozzle.

4. The combination set forth in claim 3 wherein each nozzle is coupled to first and second flow metering means coupled respectively to the sources of water and air, each of said first and second flow metering means being operative for controlling the flow rates of water and air, respectively, the control means being coupled to said flow metering means for adjusting said flow rates.

5. A method of controlling the cooling of a metal strand being cast in an elongate, open ended continuous casting mold, the steps of separately measuring the temperature at a plurality of discrete spaced apart locations around and along the length of said mold, directing a separate cooling water spray at each of said locations, and individually adjusting the flow rate of water directed at each location in response to the temperature being measured at a plurality of said mold locations.

6. The method set forth in claim 5 wherein the mold is vertically oriented and the flow rates of water and air is adjusted in a nozzle whose spray is impacting an area of the mold located above the mold area being measured.

* * * * *